US005137378A

United States Patent [19]

Satoh

[11] Patent Number: 5,137,378

[45] Date of Patent: Aug. 11, 1992

[54] THERMAL PRINTER HAVING RIBBON CONSERVING MECHANISM

[75] Inventor: Mitsuyoshi Satoh, Miyagi, Japan

[73] Assignee: Tohoku Ricoh Co., Ltd., Shibata, Japan

[21] Appl. No.: 704,080

[22] Filed: May 22, 1991

[51] Int. Cl.[5] ..... B41J 2/32; B41J 33/388

[52] U.S. Cl. ..... 400/120; 400/231; 400/248

[58] Field of Search ..... 400/120, 120 HE, 224.1, 400/231.234, 236, 236.2, 248

[56] References Cited

U.S. PATENT DOCUMENTS 4,955,738 9/1990 Uchikata et al. ..... 400/120

FOREIGN PATENT DOCUMENTS 127168 7/1985 Japan ..... 400/120 HE
151086 8/1985 Japan ..... 400/120 HE
234875 11/1985 Japan ..... 400/231
119089 5/1987 Japan ..... 400/120 HE
122572 5/1988 Japan ..... 400/120 HE

*Primary Examiner*—Edgar S. Burr

*Assistant Examiner*—Stephen R. Funk

*Attorney, Agent, or Firm*—Spencer, Frank & Schneider

[57] ABSTRACT

A thermal printer for printing on sheets of paper includes a drive motor having a gear train rotatably connected thereto. A ribbon take-up roll is rotated by rotation of the drive motor via the gear train and a thermal transfer ribbon is taken up by the ribbon take-up roll. A platen is provided on which a sheet of paper and the thermal transfer ribbon are held together during printing. A thermal head is supplied with electric printing signals when the thermal transfer ribbon and the sheet are held on the platen and selectively transfers ink from the thermal transfer ribbon to the sheet based on the electric printing signals. An electromagnetic actuator is actuated when no electric printing signals are supplied to the thermal head and a prescribed blank portion which need not be printed exists. While the actuator moves the thermal head away from the platen, the detent plate simultaneously engages with a gear of the gear train by movement of an actuator plate spring to stop rotation of the gear. A clutch mechanism operates when the detent plate is engaged and stops transmission of rotation of the drive motor to the ribbon take-up roll.

4 Claims, 6 Drawing Sheets

THERMAL PRINTER HAVING RIBBON CONSERVING MECHANISM

BACKGROUND OF THE INVENTION

1. Field of the Invention

The present invention relates to a thermal printer for use as a label printer or the like. More particularly, it relates to a thermal printer which performs recording by means of transmitting the rotation of a drive motor to a ribbon take-up roll so as to take up a thermal transfer ribbon, feeding a sheet of paper on top of the thermal transfer ribbon, both the paper and the ribbon being fed, pressing a thermal head to a platen with the sheet of paper and the ribbon grasped therebetween, and supplying an electric current to the thermal head on the basis of recording signals to that the ink of the thermal transfer ribbon is transferred to the sheet of paper.

2. Background Information

Hitherto, in this type of thermal printer, since a thermal transfer ribbon is fed and taken up along with a sheet of paper even when a blank portion which needs not be printed exists in one line, a portion of the ribbon which corresponds to the blank portion is taken up with that ribbon portion being unused. Therefore, ribbons are consumed wastefully and running costs are high. Hence, there are previously been available a thermal pitcher in which a motor for rewinding a thermal transfer ribbon is provided to eliminate such a wasteful consumption of ribbons. After an unused portion of a thermal transfer ribbon which is fed together with the feed of a sheet of paper is taken up, a thermal head is separated from a platen so as to release the mutually pressed contact of the thermal transfer ribbon and the paper sheet. The taken-up, unused ribbon is then rewound to a supply side by means of the above rewinding motor so that it is supplied once more.

In such a thermal printer, however, a motor for rewinding a thermal transfer ribbon and parts related to it are required, and manufacturing costs therefore rise. Also, it has drawbacks in that time is required to rewind a once taken-up, unused thermal transfer ribbon, and printing speed decreases by such time. In addition, there are problems in that when a rewound thermal transfer ribbon is used again, the thermal transfer ribbon is wrinkled during the re-supply operation if the rewound state is poor, and hence printing quality decreases.

Accordingly, an object of the present invention is to prevent the increase in costs thereof and to prevent a decrease in printing speed and in printing quality.

SUMMARY OF THE INVENTION

To this end, according to the present invention, there is provided a thermal printer comprising: a drive motor; a ribbon take-up roll which transmits the rotation of a drive motor via a gear train; a thermal transfer ribbon which is taken up by the ribbon take-up roll; a platen by means of which a sheet is fed on top of the thermal transfer ribbon, both of which are then transported; a thermal head which supplies an electric current on the basis of recorded signals in a state in which the thermal transfer ribbon and the sheet are grasped by the platen pressed thereto and which transfers the ink of the thermal transfer ribbon to the sheet; an electromagnetically actuated means which is actuated when no recorded signals exist in a case where a prescribed blank portion which needs not be printed exists in recording data; an actuating member for making the thermal head move by the electromagnetically actuated means so that it separates from the platen; a detent member which at the same time engages with one gear of the gear train by the movement of the actuating member so as to stop the rotation thereof; and a clutch mechanism which operates when the detent member is engaged and stops the transmission of rotation of the drive motor to the ribbon take-up roll.

When no recorded signals exist in a case where a prescribed blank portion which need not be printed exists in recording data, the electromagnetically actuated means is actuated to separate the thermal head from the platen. At the same time, the detent member engages one gear of a gear train which transmits the rotation of the drive motor to the ribbon take-up roll. The clutch mechanism is operated to stop the transmission of the rotation thereof and the transport of the thermal transfer ribbon is stopped.

To this end, according to the present invention, there is provided a thermal printer comprising: a drive motor; a ribbon take-up roll which transmits the rotation of the drive motor via a gear train; a thermal transfer ribbon which is taken up by the ribbon take-up roll; a platen by means of which a sheet is fed on top of the thermal transfer ribbon, both of which are then transported; a thermal head which supplies an electric current on the basis of recorded signals in a state in which the thermal transfer ribbon and the sheet are grasped by the platen pressed thereto, and which transfers ink of the thermal transfer ribbon to the sheet; an electromagnetically actuated means which is actuated when no recorded signals exist in a case where a prescribed blank portion which needs not to be printed exists in recording data; an actuating member for making the thermal head move by the electromagnetically actuated means so that it separates from the platen; a detent member which at the same time engages with a ribbon feed roll or with a rotation shaft on which the roll is mounted by the movement of the actuating member so as to stop the rotation thereof; and a clutch mechanism which operates when the detent member is engaged and stops the transmission of the rotation of the drive motor to the ribbon take-up roll.

When the electromagnetically actuated means is actuated, the rotation of the ribbon feed roll is stopped by the detent member; accordingly the ribbon take-up roll stops rotating because the transmission of the rotation is stopped by the clutch mechanism. Thus, the transport of the thermal transfer ribbon is stopped.

To this end, according to the present invention, there is provided a thermal printer comprising: a ribbon guide member which is disposed so as to be movable together with the thermal head, and which separates the transferred thermal transfer ribbon from the sheet and guides it to the ribbon take-up roll; and a pressing member for pressing the floating of a sheet due to the stiffness of the sheet when the ribbon guide member is moved together with the thermal head by making the thermal head separate from the platen.

When the thermal head separates from the platen, the ribbon guide member is moved together with the thermal head. The close contact of the thermal transfer ribbon and the sheet is released, and the sheet is pressed by the pressing member to prevent it from floating.

These and other objects, features and advantages of the present invention will become clear when reference is made to the following description of the preferred embodiments of the present invention, together with reference to the accompanying drawings.

DESCRIPTION OF THE PREFERRED EMBODIMENTS

Embodiments of the present invention will be explained hereinbelow in detail with reference to the accompanied drawings.

Figure 1:
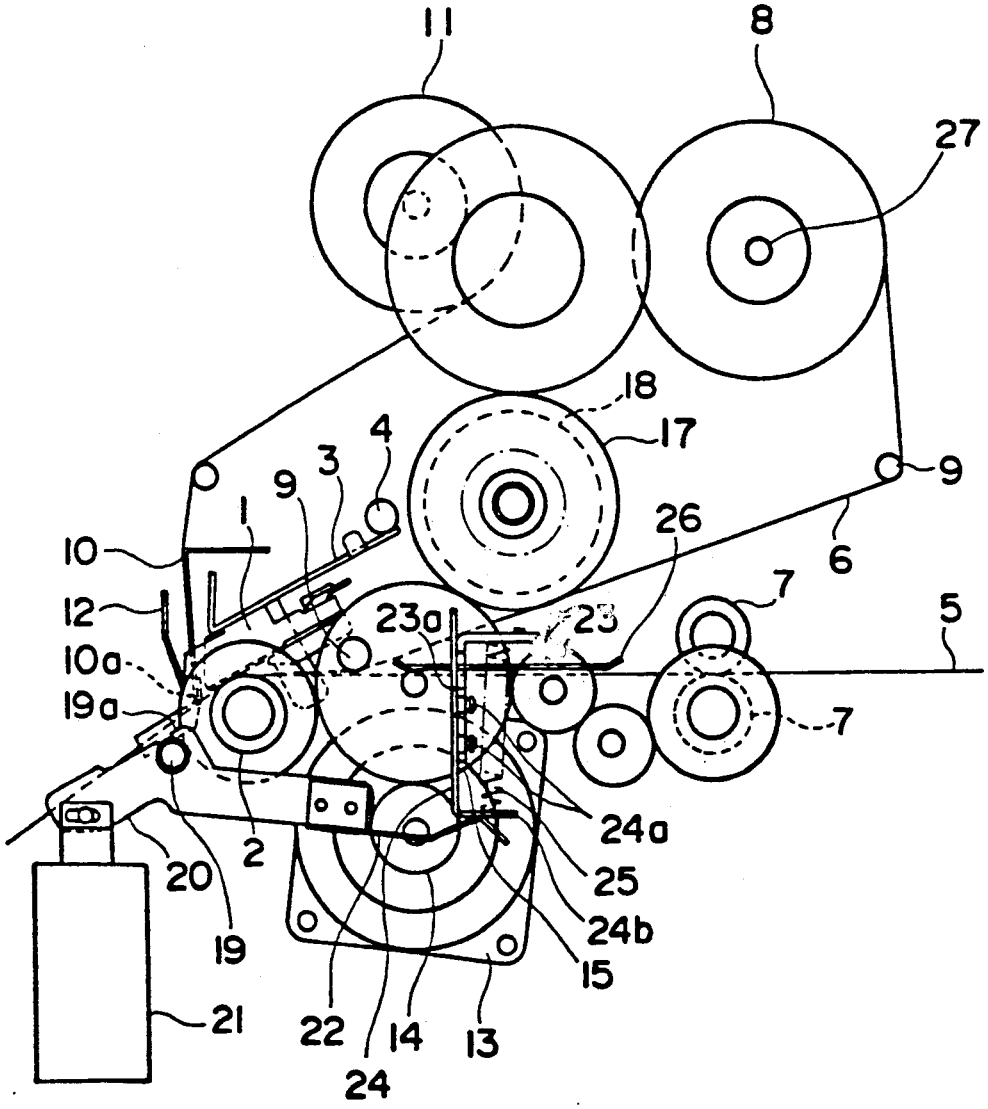
FIG. 1 is a view schematically showing the construction of the essential portion of a first embodiment of a thermal printer of the present invention.

FIG. 1 is a view showing the construction of the essential portion of an embodiment of a thermal printer of the present invention. In FIG. 1, reference numeral 1 denotes a thermal head; and 2 denotes a platen. The thermal head 1 is mounted on a frame 3 and is rotatably supported by the end section of the frame 3 about a supporting shaft 4 as shown in the figure. A sheet 5 and a thermal transfer ribbon 6 are made to overlap against each other between thermal head 1 and platen 2 and are grasped therebetween. The sheet 5 is fed out by a pair of feed rollers 7 and 7 and transported between thermal head 1 and platen 2. The sheet is taken up or drawn out by an unillustrated roll or the like. The thermal transfer ribbon 6 passes between thermal head 1 and platen 2 through guide rollers 9 and 9 from a ribbon supply roll 8. It passes a guide section 10*a* in the lower edge of a ribbon guide member 10 and is taken up by a take-up roll 11.

The ribbon guide member 10 is made of a plate in a cross-sectional shape of an upside-down letter L. This ribbon guide member 10, though not shown, is integrally mounted to frame 3 of thermal head 1 and is positioned on an extension surface of a bottom surface of thermal head 1.

On the left side of ribbon guide member 10 in the figure, a pressing member 12 in the form of a plate is mounted to a base frame (not shown). The lower end of pressing member 12 is positioned closer to guide section 10*a* of ribbon guide member 10.

Figure 3:
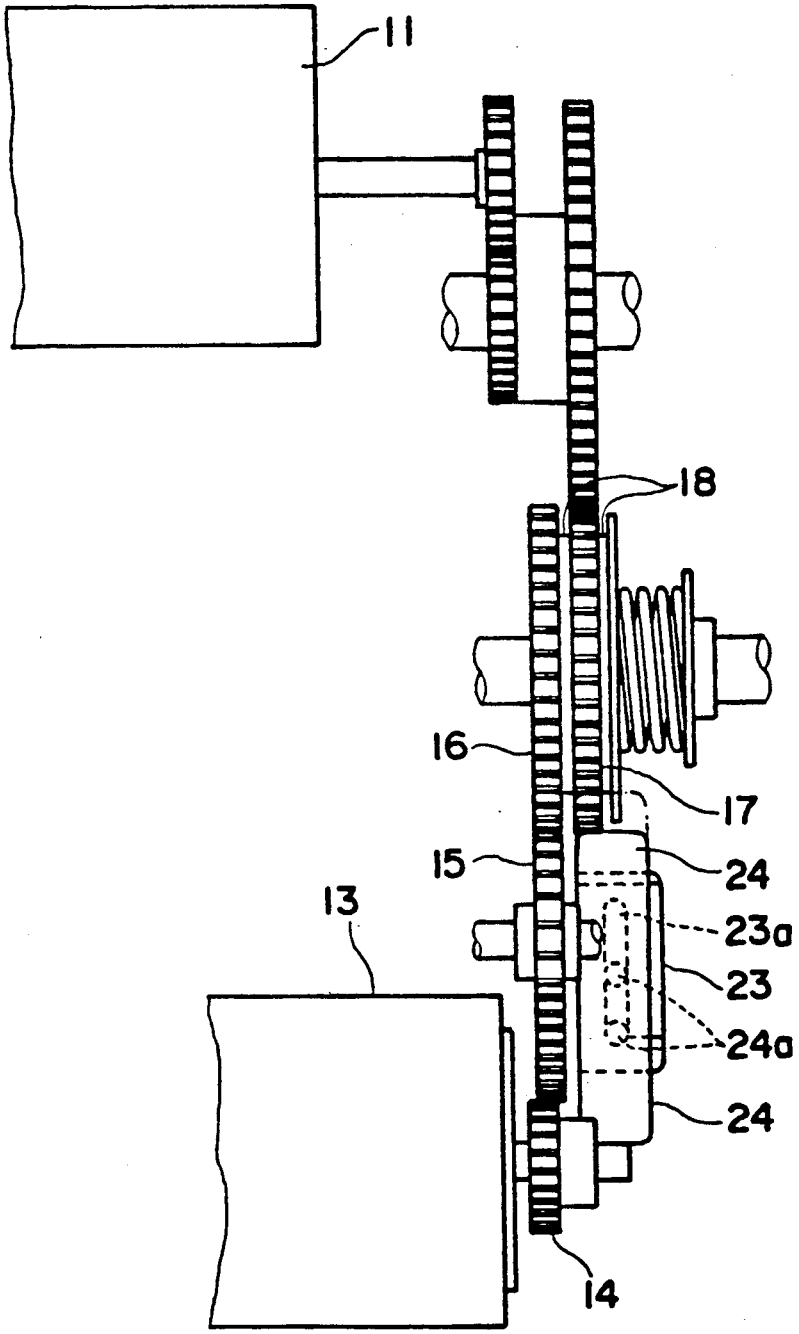
FIG. 3 is a side view showing a gear train between a drive motor and a ribbon take-up roll.

In FIG. 1, reference numeral 13 denotes a drive motor. The drive motor 13 drives ribbon take-up roll 11 via one of two gear trains from a main gear 15 which meshes with a drive gear 14 on the shaft of motor 13. The drive motor 13 also drives feed rollers 7, 7 via another gear train. In addition, platen 2 is driven by a gear which meshes with main gear 15. As shown in FIG. 3, a friction clutch (clutch mechanism) 18, which transmits the rotation of ear 16 by means of friction of a pressed friction plate, is provided between gear 16, which meshes with main gear 15, and a gear 17 disposed on the same shaft as gear 16.

Figure 2:
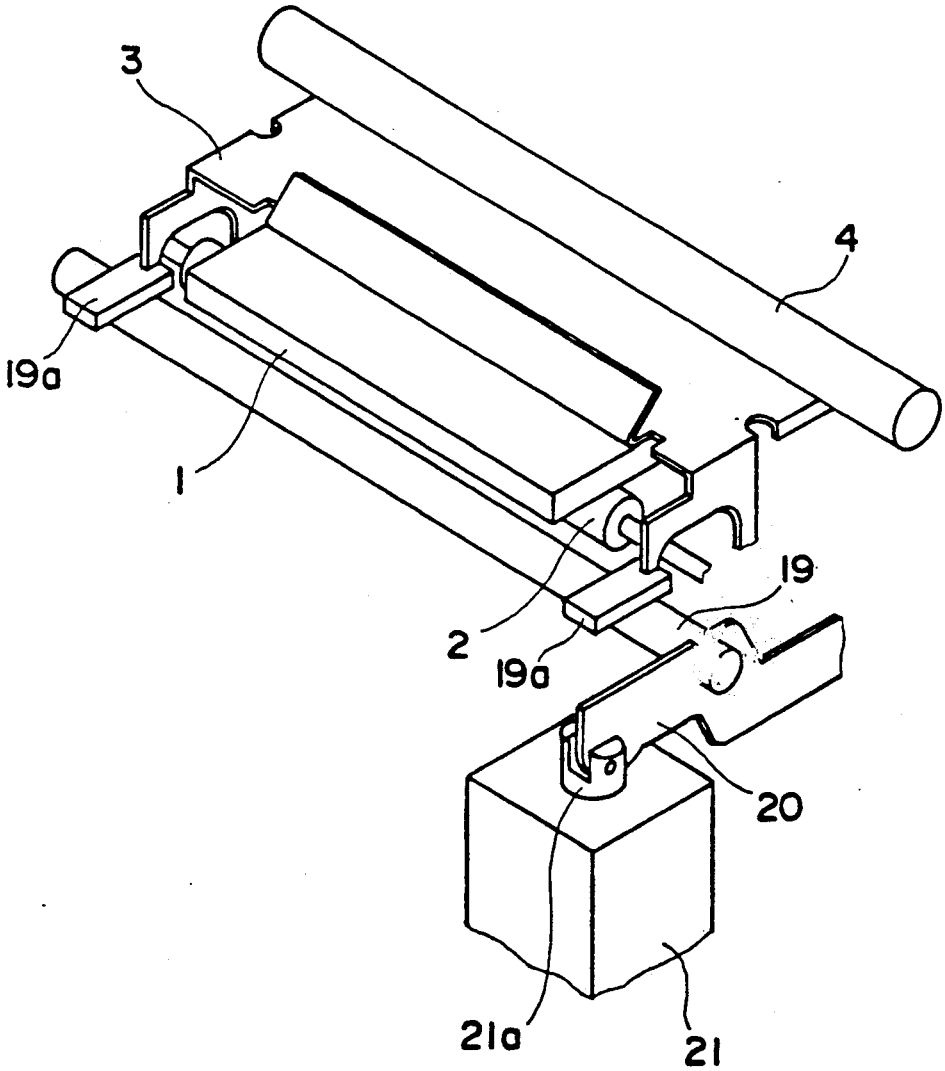
FIG. 2 is a perspective view of the printing section of the thermal printer shown in FIG. 1.
Figure 4:
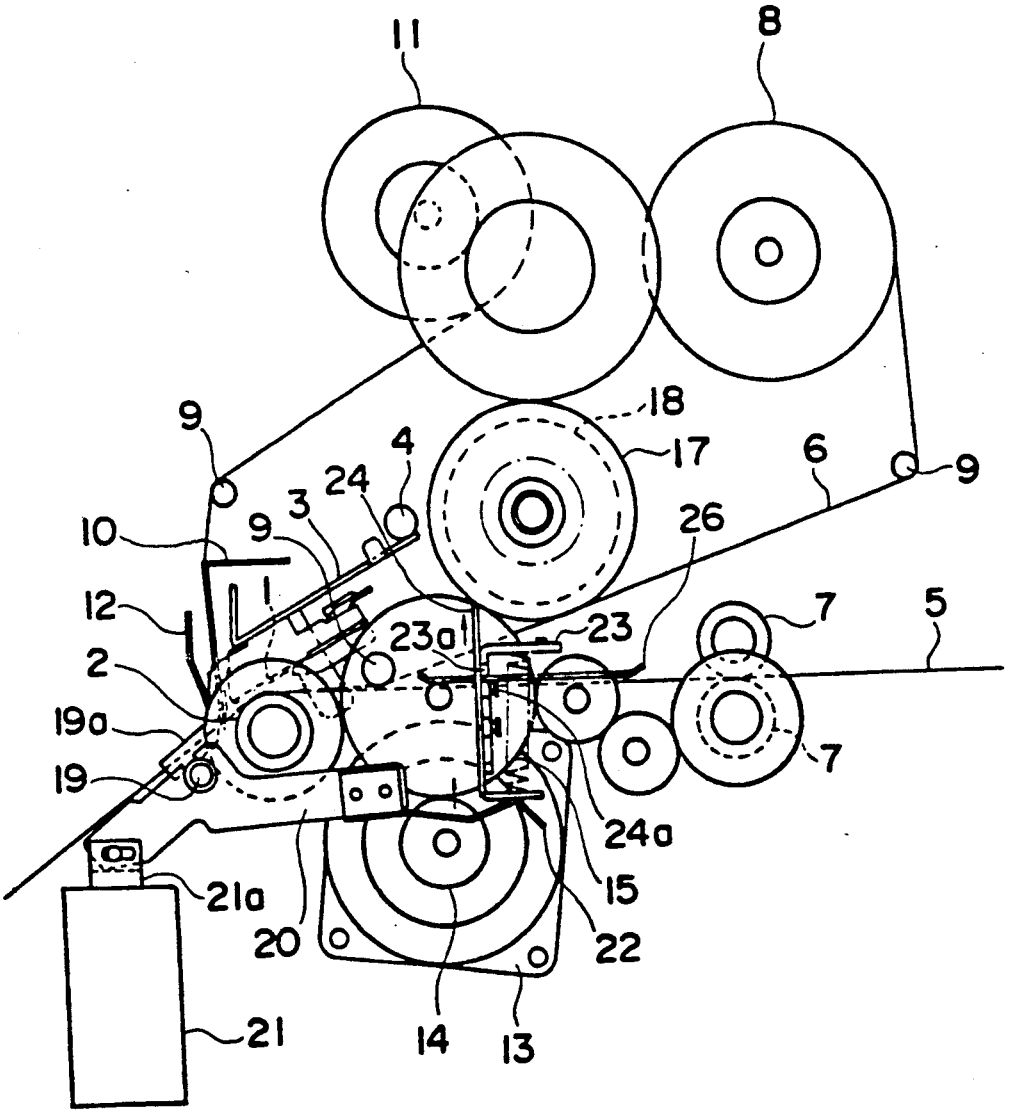
FIG. 4 is a view schematically showing the construction of the essential portion of the thermal printer according to the first embodiment when the electromagnetically actuated means is actuated.

In FIG. 2, reference numeral 20 denotes an arm fixed to a supporting shaft 19. The arm 20 is rotatably connected at one end thereof with a plunger 21*a* of a solenoid 21, and can swing in accordance with the vertical movement of the plunger 21*a*. A plate spring 22 is provided on the other end of this arm 20 in a direction of its extension (see FIG. 1). On supporting shaft 19, a receiving section 19*a* in the form of a small piece is provided on a peripheral surface of supporting shaft 19. The top surface of this receiving section 19*a* is brought into abutment with a free end side of frame 3 so that thermal head 1 is supported. The downward movement of plunger 21*a* of solenoid 21 allows arm 20 to rotate in a counter-clockwise direction in the figure with supporting shaft 19 acting as a fulcrum, as shown in FIG. 4. The supporting shaft 19 is also able to rotate in the same direction. The receiving section 19*a* mounted on supporting shaft 19 also rotates in a counter-clockwise direction, pushing up frame 3, causing thermal head 1 to be lifted.

As shown in FIG. 1, a bracket 23 in the shape of an upside-down letter L is mounted above the above-mentioned plate spring 22. Sliding holes 23*a* are provided in a vertical direction in bracket 23. Pins 24*a* and 24*a* provided on a detent plate (detent member) 24 which is shaped in the form of the letter L are inserted into sliding holes 23*a*. The detent plate 24 is mounted so as to be slidable on bracket 23. A coil spring 25 is disposed between the lower edge section 24*b* of detent plate 24 and bracket 23 so as to cause the detent plate 24 to press upon a top surface of plate spring 22. Thus, plate spring 22 and a lower edge section 24*b* of detent plate 24 are brought into abutment with each other. The top end of detent plate 24 is made to engage with an unillustrated engagement section disposed between the teeth of or on gear 17 in response to the swinging movement of arm 20. The friction clutch 18 is made to slip, causing gear 17 to stop rotating. In FIG. 1, reference numeral 26 denotes a guide disposed along the sheet transport path between feed rollers 7, 7, and platen 2. The guide prevents paper jamming which may be likely to occur because the sheet transport path is long.

In such a thermal printer constructed as described above, thermal transfer ribbon 6, as shown in FIG. 1, is transported from ribbon supply roll 8 by driving ribbon take-up roll 11 by means of drive motor 13 via a gear train. At the same time, thermal transfer ribbon 6 is fed on top of sheet 5 which is fed by the feed rollers 7, 7 driven by drive motor 13 via another gear train. Both thermal transfer ribbon 6 and sheet 5 move between platen 2 and thermal head 1. The thermal transfer ribbon 6 is separated from sheet 5 by guide section 10*a* of ribbon guide member 10 and is taken up by ribbon take-up roll 11. The sheet 5, on the other hand, is fed as it is. In the meantime, the supplying of an electric current to thermal head 1 on the basis of recorded signals causes ink of thermal transfer ribbon 6 to be transferred to sheet 5 in a state in which sheet 5 and thermal transfer ribbon 6 are grasped between thermal head 1 and platen 2. Thus, recording, i.e., thermal printing, is performed on sheet 5.

Figure 6:
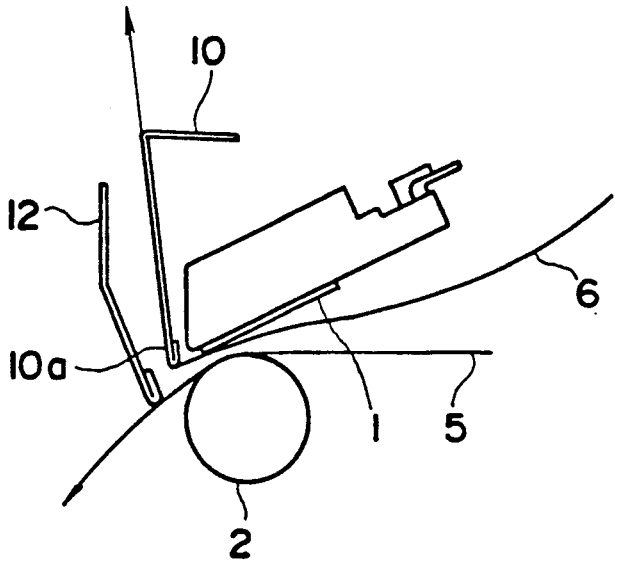
FIG. 6 is a view showing a state in which the thermal head of the printing section of the above thermal printer is separated from the platen in the first and second embodiments of the present invention.

In a case where there are prescribed number of blank portions which do not need to be printed in recording data during this recording operation, for example, in a case where no recording signals exist when blank portions are one inch long or longer, solenoid 21 is actuated to make arm 20 connected to plunger 21*a* of solenoid 21 swing, causing one end thereof to be pulled down. Thereupon, this pulling-down action pushes up plate spring 22 provided on the other end of arm 20 and makes detent plate 24 slide upward and engage with gear 17. At this time, detent plate 24 and gear 17 engage with each other elastically due to plate spring 22, and thus damage to gear 17 is prevented. Then, friction clutch 18 is operated to stop transmission of rotation from gear 16 to gear 17. Thus, rotation of ribbon take-up roll 11 is stopped, thereby stopping the movement of thermal transfer ribbon 6. The feed rollers 7, 7 and platen 2, on the other hand, continue to rotate via the other gear train. The receiving section 19*a* disposed on supporting shaft 19 pushes up a free end side of frame 3 of thermal head 1 at the same time as arm 20 is made to swing. This pushing-up action swings thermal head 1 with the supporting shaft 4 acting as a fulcrum, makes thermal head 1 float from platen 2, and also makes ribbon guide member 10 float, thus releasing thermal transfer ribbon 6 from contact with sheet 5. At this time, as shown in FIG. 6, sheet 5 is pressed by pressing member 12 after passing a contacting section of sheet 5 and platen 2 in order to prevent sheet 5 from floating in the direction of movement of sheet 5. When sheet 5 is reversely moved, if feed rollers 7, 7 are reversely rotated, reverse movement of thermal transfer ribbon 6 is prevented and slackening of thermal transfer ribbon 6 can be prevented by making thermal head 1 float in a manner similar to that described above.

Thereafter, when recorded signals occur, plunger 21*a* of solenoid 21 returns to its original position, and thermal head 1 which has been separated from platen 2 is brought into abutment with platen 2, causing thermal transfer ribbon 6 and sheet 5 to be grasped between thermal head 1 and platen 2. The detent plate 24 is promptly pulled down by the driving force of coil spring 25 and slips out of gear 17. Then, ribbon take-up roll 11 rotates, causing thermal transfer ribbon 6 to move together with sheet 5.

An arrangement in the above-described embodiment has been explained in which the detent plate 24 is engaged with gear 17 of a gear train which transmits the rotation of ribbon take-up roll 11 due to the operation of solenoid 21. The present invention can also be arranged so that movement of thermal transfer ribbon 6 is stopped by stopping the rotation of ribbon supply roll 8, as described below.

Figure 5:
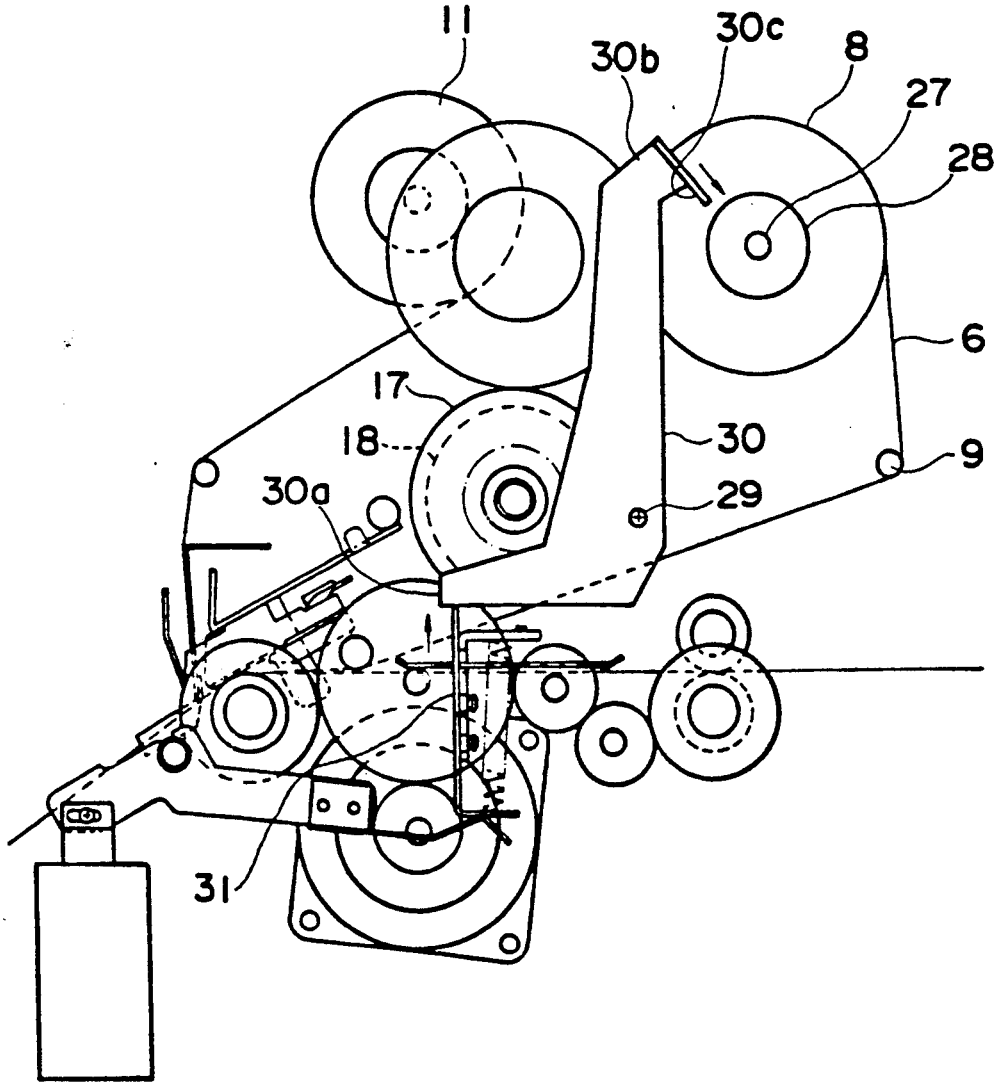
FIG. 5 is a view schematically showing the construction of the essential portion of a second embodiment of a thermal printer according to the present invention.

In this case, as shown in FIG. 5, a gear 28 is fixed to rotation shaft 27 of ribbon supply roll 8. The present invention has an arrangement in which a thrust plate 31 is vertically slidable in the same manner as the above detent plate 24 and a detent plate (detent member) 30 is swung together with a supporting shaft 29 acting as a fulcrum by the upward movement of thrust plate 31, with one end 30*a* of detent plate 30 being connected to thrust plate 31. Thus, the movement of thermal transfer ribbon 6 is stopped by this detent plate 30.

That is, the one end 30*a* of detent plate 30 is thrust up by thrust plate 31 due to the swinging movement of arm 20, thereby causing the other end 30*b* to move in the direction of the adjacent arrow in FIG. 5 so that an engagement section 30*c* disposed on end 30*b* engages with gear 28 which is disposed on either the ribbon feed roll or the shaft on which the ribbon feed roll is mounted. As a result, the rotation of ribbon supply roll 8 is stopped. Then, gear 17 of the gear train which transmits the rotation to the ribbon take-up roll 11 makes gear 16 idly rotate by means of friction clutch 18, causing the rotation of ribbon take-up roll 11 to be stopped.

In this case, where there is a possibility that sheet 5 will be reversely moved, it is required that a one-way clutch be provided on gear 17, or a gear which engages this gear 17, in order to prevent the reverse rotation of the gear and prevent thermal transfer ribbon 6 from moving backward.

As has been explained above, according to the thermal printer described in the above embodiment, when no recorded signals occur for a preset amount of time, the rotation of ribbon take-up roll 11 is stopped and thus transporting of thermal transfer ribbon 6 is stopped. Therefore, wasteful consumption of ribbons is eliminated and an associated increase in costs is prevented. Also, a decrease in printing speed and in printing quality can be prevented.

In addition, according to the thermal printer of the present embodiment, since pressing member 12 which presses sheet 5 is provided thereon, even if sheet 5 is, for example, thick paper, such as tag paper having a strong stiffness, sheet 5 is prevented from floating by being pressed by pressing member 12. Therefore, rubbing of the surface of sheet 5 against an ink surface of thermal transfer ribbon 6 during the transport of the sheet is prevented. It is thus possible to prevent staining of sheet 5, thereby preventing a decrease in printing quality.

Many different embodiments of the present invention can be made without departing from the spirit and scope thereof; therefore, it is to be understood that this invention is not limited to the specific embodiments described above and is solely defined in the appended claims.

What is claimed is:

1. A thermal printer for printing on a sheet fed therethrough by a sheet feed mechanism, comprising:

a drive motor for driving the sheet feed mechanism and having a gear train rotatably connected thereto;

a ribbon take-up roll which is rotated by rotation of the drive motor via the gear train;

a thermal transfer ribbon which is taken up by the ribbon take-up roll;

a platen over which a sheet is fed next to the thermal transfer ribbon, the sheet and the ribbon being fed in the same direction and held together on the platen during printing;

a thermal head to which is supplied electric printing signals when the thermal transfer ribbon and the sheet are held on the platen for selectively transferring ink of the thermal transfer ribbon to the sheet based on the electric printing signals;

electromagnetically actuated means, actuated when no electric printing signals are supplied to the thermal head and a prescribed blank portion which need not be printed exists, including an actuating member for moving the thermal head away from the platen, the actuating member having a plate spring provided thereon;

a detent plate which engages with a gear of said gear train by movement of the actuating member plate spring while the thermal head is moving away from the platen to stop rotation of the gear; and a clutch mechanism which operates when the detent plate is engaged and stops transmission of rotation of the drive motor to the ribbon take-up roll.

2. A thermal printer as claimed in claim 1, further comprising:

a ribbon guide member which is disposed so as to be movable together with said thermal head, for separating the thermal transfer ribbon from the sheet and for guiding the thermal transfer ribbon to the ribbon take-up roll; and a pressing member for pressing and thereby moving the sheet away from the thermal head when the ribbon guide member is moved together with the thermal head and the thermal head is being moved away from said platen.

3. A thermal printer for printing on a sheet fed therethrough by a sheet feed mechanism, comprising:

a drive motor for driving the sheet feed mechanism and having a gear train connected thereto;

a ribbon take-up roll which is rotated by rotation of the drive motor via the gear train;

a ribbon feed roll mounted on a shaft and rotated by rotation of the drive motor via the gear train;

a thermal transfer ribbon which is fed from the ribbon feed roll and taken up by the ribbon take-up roll;

a platen over which a sheet is fed next to the thermal transfer ribbon, the sheet and the ribbon being fed in the same direction and held together on the platen during printing;

a thermal head to which is supplied electric printing signals when the thermal transfer ribbon and the sheet are held on the platen for selectively transferring ink of the thermal transfer ribbon to the sheet based on the electric printing signals;

electromagnetically actuated means, actuated when no electric printing signals are supplied to the thermal head and a prescribed blank portion which need not be printed exists, including an actuating member for moving the thermal head away from the platen, the actuating member having a plate spring provided thereon;

a detent plate which engaged with one of the ribbon feed roll and the shaft on which the ribbon feed roll is mounted, by movement of the actuating member plate spring while the thermal head is moving away from the platen to thereby stop the rotation of the ribbon feed roll; and a clutch mechanism which operates when the detent plate is engaged and stops transmission of rotation of the drive motor to the ribbon take-up roll.

4. A thermal printer as claimed in claim 3, comprising:

a ribbon guide member which is disposed so as to be movable together with said thermal head for, separating the thermal transfer ribbon from the sheet and for guiding the thermal transfer ribbon to the ribbon take-up roll; and a pressing member for pressing and thereby moving the sheet away from the thermal head when the ribbon guide member is moved together with the thermal head and the thermal head is being moved away from said platen.

* * * * *